United States Patent [19]

Salam

[11] Patent Number: 4,541,189

[45] Date of Patent: Sep. 17, 1985

[54] MATRIX DISPLAYS

[76] Inventor: Hassan P. A. Salam, 63 Lowther Rd., Barnes, London SW13, England

[21] Appl. No.: 477,735

[22] Filed: Mar. 22, 1983

[30] Foreign Application Priority Data

Mar. 24, 1982 [GB] United Kingdom ..... 8208689

[51] Int. Cl.[4] ..... G09F 3/04

[52] U.S. Cl. ..... 40/447; 40/449

[58] Field of Search ..... 40/447, 530, 449, 451, 40/452, 486

[56] References Cited

U.S. PATENT DOCUMENTS

| | | | |
|---|---|---|---|
| 567,379 | 9/1896 | Dalumi | 40/447 |
| 3,096,594 | 7/1963 | Skrobisch | 40/449 |
| 4,163,332 | 8/1979 | Salam | 40/449 |
| 4,259,801 | 7/1981 | Ito | 40/449 |

*Primary Examiner*—Gene Mancene

*Assistant Examiner*—Wenceslao J. Contreras

*Attorney, Agent, or Firm*—Laubscher & Laubscher; Laubscher & Laubscher

[57] ABSTRACT

A matrix display device includes an array of display elements each comprising a member (12) rotatable between two states and an array of bearing elements (13) associated with said rotatable members manufactured as a single piece, such as a frame (11).

This allows an improved method of manufacture of such display devices in that a matrix sheet (1) having display apertures (2) and bearing members (3) is produced with spacing such that the frame (11) of display element members (12) aligns with the matrix sheet and the respective bearing elements (13) and members (3) can interengage simultaneously, resulting in saving of time and simplification of the assembly procedure. Once interengaged, the residual parts of the frame (11) are severed and discarded. Matrix sheet (1) is also made as a single piece, enabling a whole matrix of hinged display elements to be made from only two or three parts.

29 Claims, 9 Drawing Figures

MATRIX DISPLAYS

BACKGROUND OF THE INVENTION

This invention concerns matrix displays of the type in which each display element comprises a member rotatable about an axis parallel to the plane of the matrix between two states to alter the appearance of the display element. Displays of this type include those described in U.S. Pat. Nos. 4,163,332, 3,140,553, 4,015,255 and 4,070,668.

In general, manufacture of such matrix displays is a time-consuming procedure in that display elements are mounted individually on the matrix. This becomes a particular disadvantage with displays having a large number of elements.

An object of the present invention is to reduce the number of separate parts needed to manufacture matrix displays of the above-mentioned type, and to simplify the assembly procedure so as to reduce the cost.

SUMMARY OF THE INVENTION

A display device according to the invention includes an array of display elements each comprising a member rotatable between two states and an array of bearing elements associated with said rotatable members manufactured as a single piece.

In accordance with the invention, there is provided a method of manufacturing a display device which includes a matrix sheet carrying display element members rotatable about an axis parallel to the plane of the matrix sheet. The method includes producing the matrix sheet with first bearing parts; producing an assembly of the display element members on a carrier structure, the members having second bearing parts for engagement with the first bearing parts on the matrix sheet, the display element members being carried by the structure so as to be alignable with desired locations on the matrix sheet; superimposing the assembly of display element members with the matrix sheet such that the first and second bearing parts engage; and removing the carrier structure of the assembly.

Features and advantages of the present invention will become apparent from the following description of a preferred embodiment thereof, given by way of example, with reference to the accompanying drawings.

DETAILED DESCRIPTION OF THE PREFERRED EMBODIMENTS

The invention will be described with reference to displays described in U.S. Pat. No. 4,163,332, but it is applicable to other types. Reference is directed to this disclosure for further details of a suitable display, such as back lighting and electromagnetic actuation of display elements.

Figure 1:
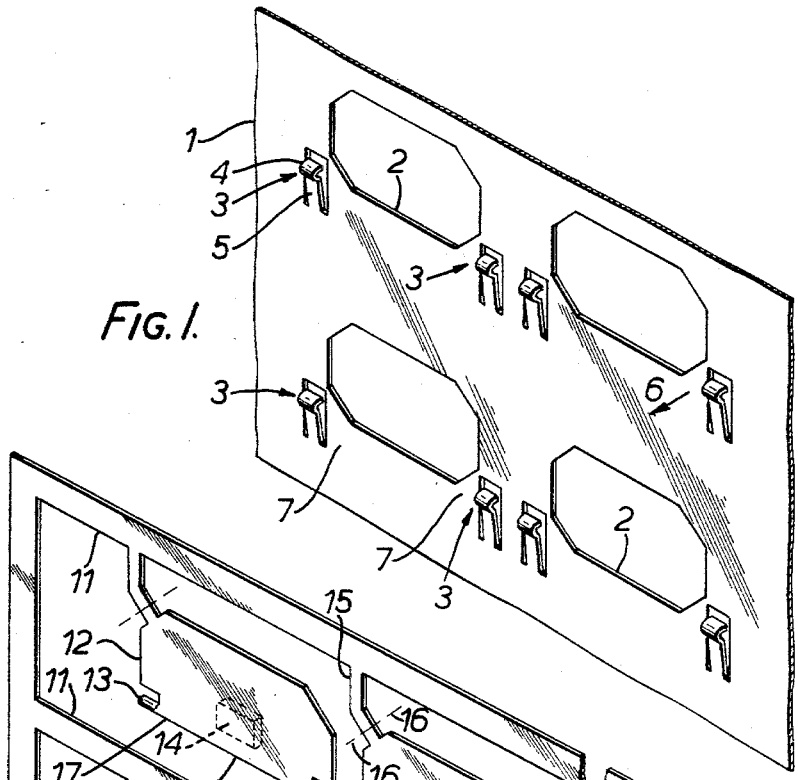
FIG. 1 illustrates one of two parts for making a matrix of rotatable display members.
Figure 3A:
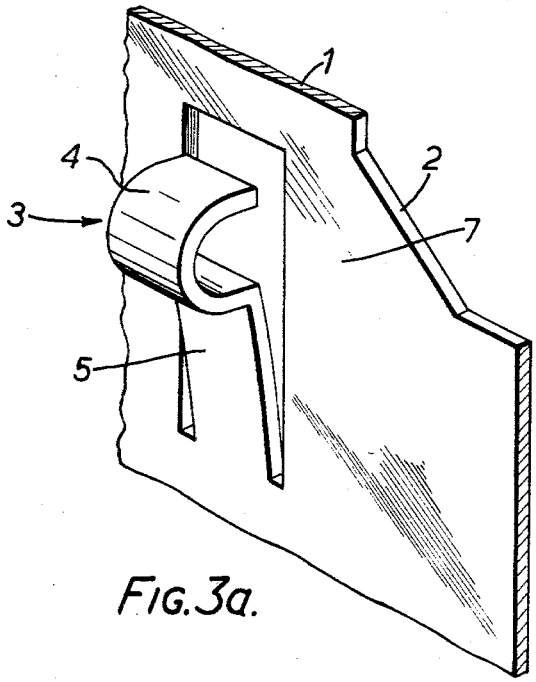
FIGS. 3*a*, 3*b* and 3*c* illustrate various detail views of a portion of the part in FIG. 1 and its constructional relationship to a corresponding portion of the part in FIG. 2.

Referring to FIGS. 1 and 3*a*, a display device includes a sheet-like member 1 of opaque material which is pliable. It may be of synthetic plastic material or sheet metal, such as spring steel. Member 1 includes a matrix of display apertures 2 arranged in rows and columns. Only two rows and two columns are shown, for convenience of illustration, but the preferred matrix has more rows and columns. On either side of each aperture 2 is a bearing component 3 having a hollow partially cylindrical portion 4, the inside surface of which serves as a bearing, and an elongate portion 5 which serves as a spring. The whole of sheet 1 complete with its bearing components 3 is made as one piece, for example by injection moulding using synthetic plastic material or by pressing out of a sheet of spring steel. Sheet 1 is preferably made black and this is preferably done by arranging that the stock out of which it is made is colored black.

Figure 2:
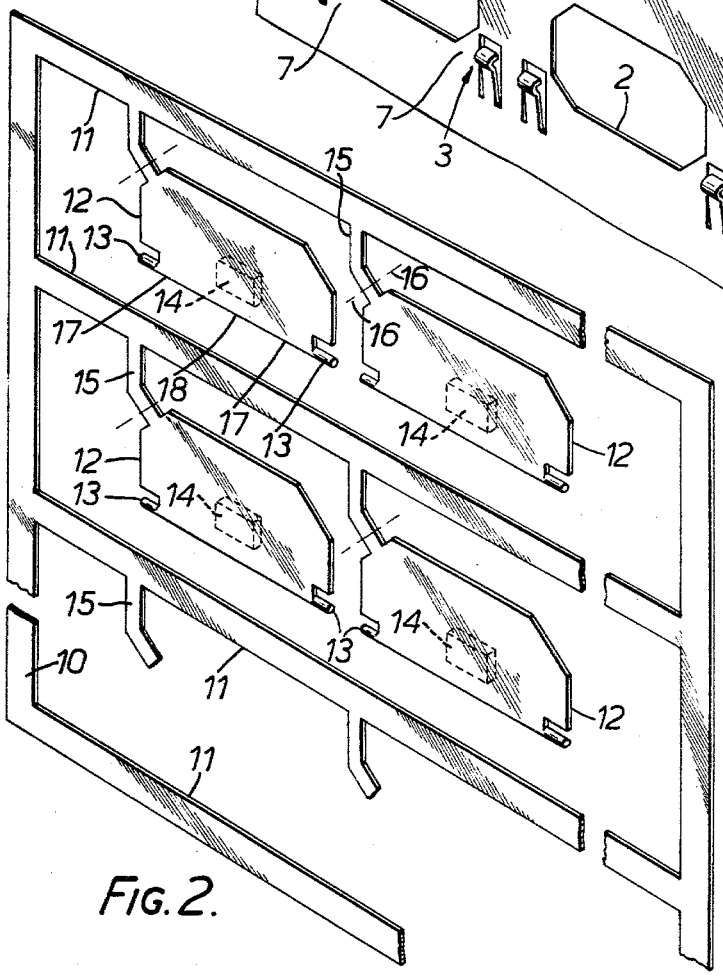
FIG. 2 illustrates the other of the two parts.

FIG. 2 shows a sheet-like member 10 which includes a frame 11 carrying a plurality of display element members 12 by means of support portions 15. Each member 12 includes a pair of hinge pins 13. Member 10, complete with all display element members 12 and their hinge pins 13 is made in one piece, for example by injection moulding using synthetic plastic material. Each display member 12 has a permanent magnet 14, required for its actuation, attached to it. The permanent magnets 14 are shown attached to the rearward sides of display members 12 (as viewed in FIG. 2) as this is a convenient arrangement, the distance between the bottom edge of each display member 12 and the magnet 14 being sufficient to clear the aperture 2 when installed; however, any other arrangement can alternatively be provided. Permanent magnets 14 can be formed integrally with the rest of member 10 by making member 10 out of synthetic plastic material filled with barium ferrite that can be permanently magnetized, and then magnetizing portions 14 of the member 10. Member 10 is preferably made out of black stock, and colored white on the rear side, by painting or other means.

Figure 3B:
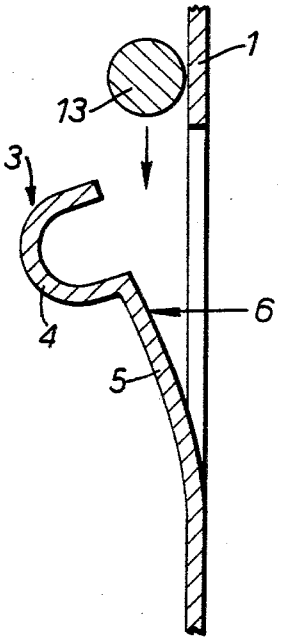
Figure 3C:
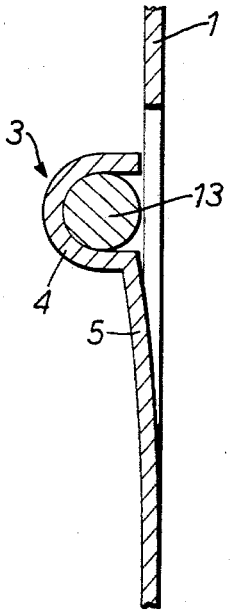
Figure 3D:
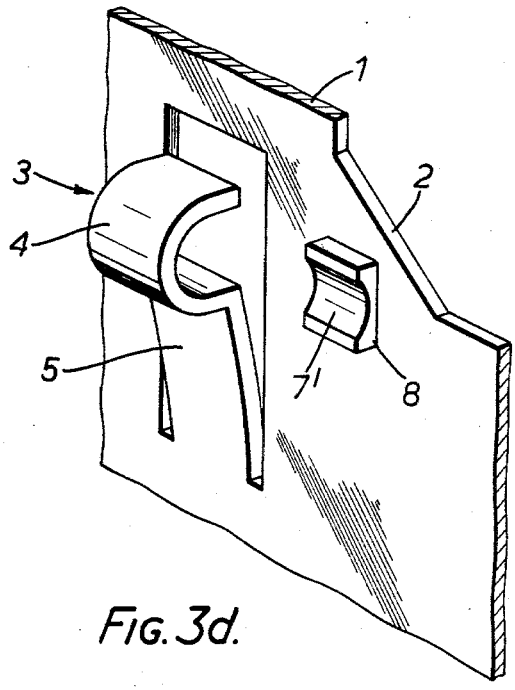
FIG. 3*d* illustrates a modified bearing arrangement compared to that of FIG. 3*a;*

A complete matrix of rotatable display members is made by superimposing member 10 on member 1 so that pins 13 are slightly above bearing members 3 as shown in FIG. 3*b*. Bearing members 3 are pressed out in the direction of arrow 6 by suitable means, which may be a jig arranged for this purpose and mounted at the rear of member 1. With all of bearing members 3 pressed out, member 10 is lowered so that pins 13 enter the hollow portions of members 3. The pressure 6 on members 3 is now released, causing members 3 to retract and capture hinge pins 13, as illustrated in FIG. 3*c*. As a final operation, all display members 12 are severed from frame 11 of member 10 at support portions 15 as indicated by dotted lines 16. Frame 11 is discarded and what is left is a complete matrix of hinged display elements, each independently free to rotate between a first position in which it covers its associated aperture and appears black, and a second position in which its white side is showing and its associated aperture is exposed. Any other combination of means selectively providing one of two contrasting appearances can be utilized as an alternative to black and white.

Referring to FIGS. 1,2 and *3a*, each rotatable member 12, as well as bearing at its pin 13 on bearing member 3, also bears at portions 17 of its lower part 18 on portions 7 in member 1 situated between the pairs of bearing elements 3. Lower edge 18 of member 12 is preferably of semi-circular cross-section.

FIG. *3d* illustrates an alternative arrangement for the bearing part provided on matrix member 1. Instead of the flat surface 7 shown in FIG. *3a*, there is provided a concave surface 7' on a protruding part 8 of the matrix member 1. This arrangement provides for more positive location of the pin 13 and also improved bearing of the display member 12.

Sheet member 10 complete with display element members 12 (but without magnets 14) can be punched as one piece out of a single sheet of material. In this case, bearing pins 13 will be of rectangular cross-section.

Figure 4:
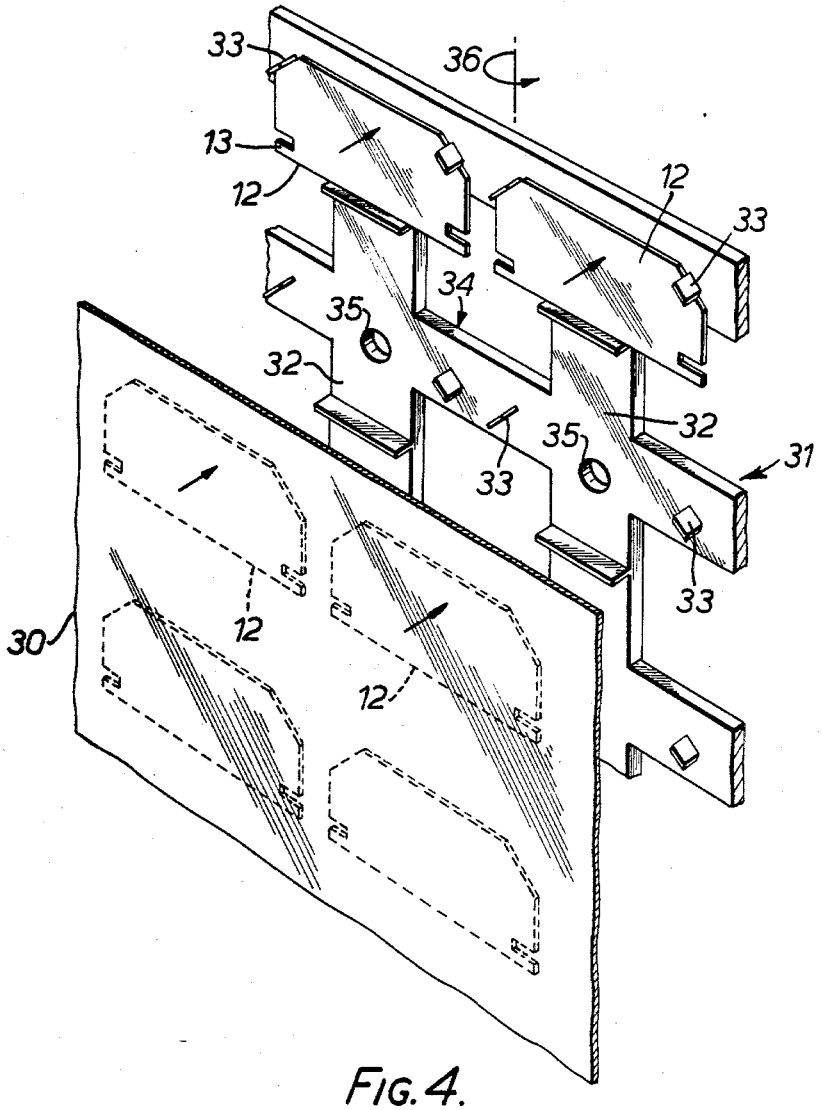
FIG. 4 illustrates an alternative method of assembling a display matrix.

FIG. 4 illustrates an alternative method of processing display element members 12. The display members 12 are punched out of a sheet of material 30 on to a carrier 31. The carrier 31 has receiving areas 32 each having retaining wall portions 33 arranged to pocket a respective one punched-out display element 12. Only two of the pockets 32 are shown loaded with display elements 12 for clarity of illustration but in practice, all pockets in the carrier can be loaded. Elements 12 are punched out of areas in the sheet 30, shown in dotted outline, that have the same center-to-center distance as do elements 12 in the final matrix. Pockets 32 of carrier 31 also have the same center-to-center distance. Once carrier 31 is loaded, it is rotated through 180 degrees in the direction of arrow 36 and superimposed on member 1 in FIG. 1 in the same way as was described with reference to member 10 in FIG. 2. Bearing pins 13 are engaged into their respective hollow bearing components 3, also as was described before. Carrier 31 is then removed from the assembly comprising member 1 and display elements 12. This removal can be assisted by pushing each element 12 out of its respective pocket 32 with the aid a blast of air directed through an aperture 35 in the pocket. The magnets can be attached to elements 12 after removal of carrier 31 by adhesive bonding or by other means.

The assembly consisting of matrix sheet member 1 and its hinged display members 12 can be mounted onto a supplementary sheet of similar or larger size than member 1 and which is opaque except for light passing areas aligned with apertures 2. The supplementary sheet can additionally serve to support the member 1.

Figure 5:
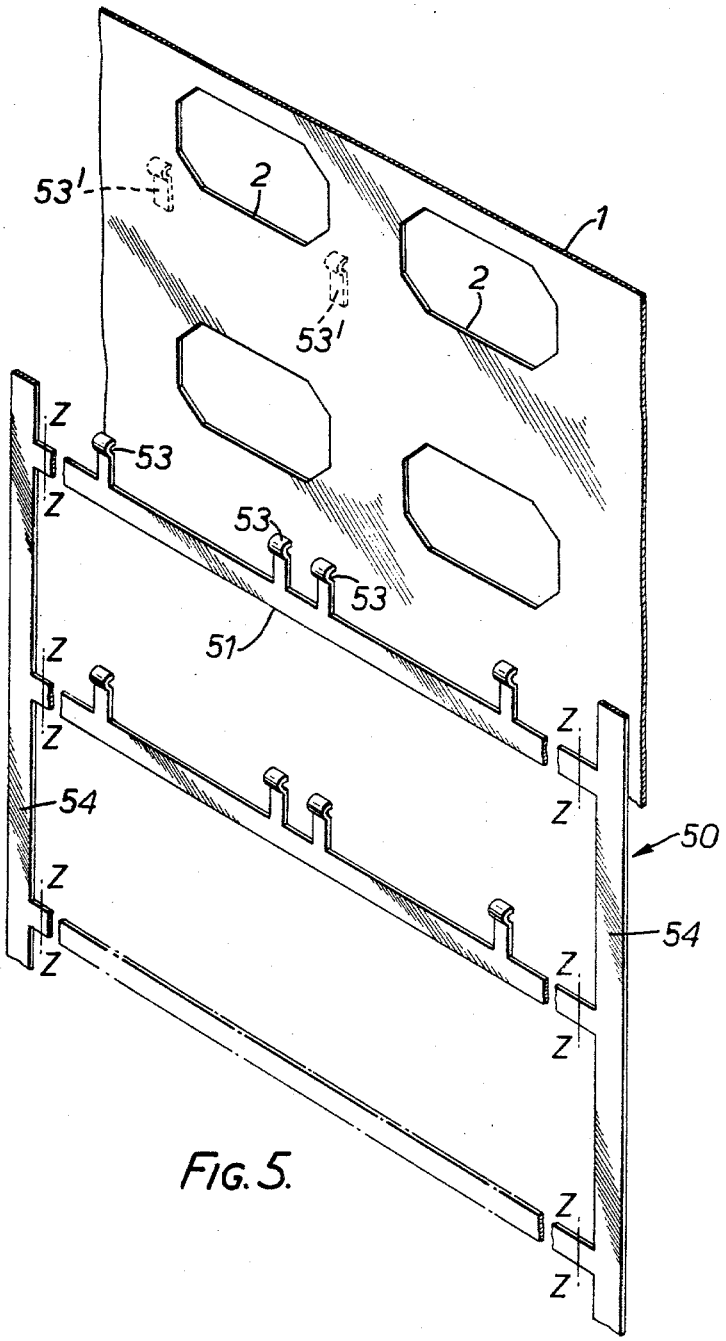
FIG. 5 illustrates another constructional method of making the first part which can then be assembled with the second part shown in FIG. 2.

FIG. 5 shows a different way in which bearing portions can be provided on the matrix sheet member 1. In this case, the member 1 is simply provided with appropriately-positioned display apertures 2 and need not be made of a resilient material (as is necessary with the FIG. 1 construction to provide the spring effect of members 3). A frame 50 carries a plurality of bearing members 53 (which can be broadly similar to spring members 3 previously described) on cross-pieces 51 of the frame 50. The cross-pieces 51 are integral with end pieces 54. The frame 50 and bearing members 53 can be manufactured as a single item as previously described, e.g. by injection moulding. In manufacture of the display, the frame 50 and bearing members are appropriately positioned and fixed to the matrix sheet member 1 (see spring members 53' in dotted outline) by suitable means, such as adhesive bonding. Either the whole frame assembly 50 may be bonded to the matrix sheet member 1, or just the cross-pieces 51, whereupon these may be severed along the lines Z—Z and the end pieces 54 discarded. The remainder of the construction may be as previously described and, to this end, it may be convenient to provide suitable means, such as openings (not shown) in the matrix member 1, to allow the displacing force to be applied to the spring members, e.g. as shown by arrow 6 in FIG. *3b*.

An alternative procedure for making the matrix using frame assembly 50 is to deposit the matrix of display elements 12 onto member 1 in FIG. 5 in their correct positions relative to apertures 2, for example by ejection from carrier 31, positioning frame 50 so that bearing components 53 cover the respective bearing pins 13 on deposited members 12 and then attaching frame 50 to member 1, for example by welding.

Members 1 and 50 in FIGS. 1 and 5 can be made of a material of good dimensional stability, such as metal or epoxy-glass resin coated or lined with a material having good bearing properties, such as nylon or acetal. The coating can if desired be carried out after the formation of the members. Display members 12 can also be coated with bearing material to prolong the bearing life of their pins 13.

In the arrangements in FIGS. 1 and 5 the pair of bearing components 3,53 respectively between each horizontal pair of display elements can be replaced by a single bearing of similar shape but increased width, arranged to accommodate one hinge pin 13 in its left side and the other in its right side.

Figure 6:
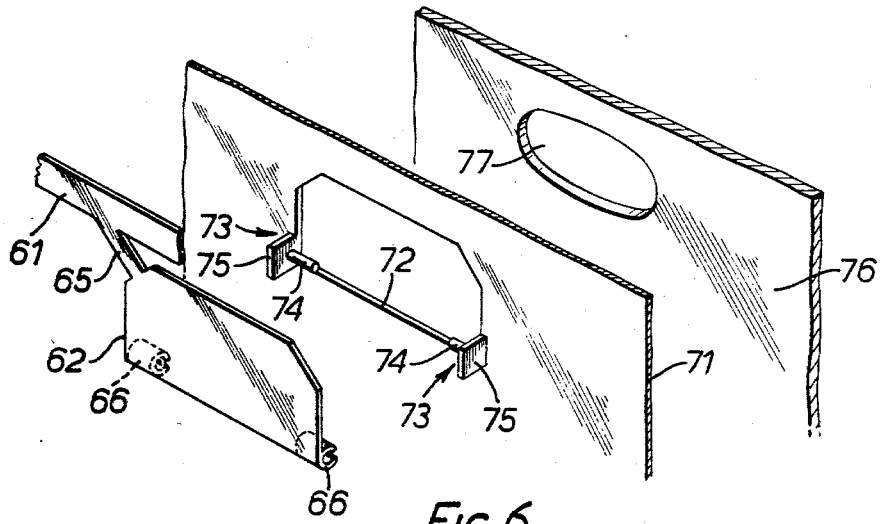
FIG. 6 illustrates a different arrangement for pivoting the display members on the matrix.

FIG. 6 shows another embodiment similar to that of FIGS. 1 and 2 but including a different hinging arrangement. Display members 62 (only one shown) are made of resilient material and are attached by support portions 65 to a frame 61 in similar manner to that previously described, but additionally include a C-socket 66 at each end. A magnet (not shown) is attached to the back of each member 62. The matrix member 71 includes respective display apertures 72 (again only one shown) with bearing members 73 at either end, each including an inwardly facing pin 74 mounted on a projection 75. Each C-socket 66 has an inner concave bearing surface of a diameter slightly larger than that of pin 74, and an opening slightly smaller than the diameter of pin 74. The C-socket 66 is resilient and springs open during insertion of pin 74 because of the elasticity of the material of display member 62. Assembly of the complete matrix can proceed, as previously described, with simultaneous engagement of bearing portions, i.e. C-sockets 66 forced around pins 74, and then discarding of brokenaway frame 61. As an alternative arrangement, the pins 74 and sockets 66 could be transposed, i.e. the pins provided on the display members (as in earlier embodiments) and the sockets on the matrix member.

A description of various modes of operation of such matrix display devices is given in the aforementioned U.S. patents, although any other suitable mode of operation may be utilized. The invention is applicable to irregular matrices, for example of the segmental type, as well as to regular matrices.

Furthermore, although the invention has been described with reference to particular embodiments, it is to be understood that these embodiments are merely illustrative of the application of the principles of the invention. Numerous modifications may be made therein and other arrangements may be devised without departing from the spirit and scope of the invention.

What is claimed is:

1. A method for manufacturing an information display device, comprising the steps of (a) producing a generally planar matrix panel member containing an array of display apertures;

(b) providing a plurality of first bearing means on said matrix panel member adjacent said display apertures;

(c) producing a generally planar carrier member containing an array of display elements corresponding with an array of display apertures, each of said display elements including second bearing means;

(d) arranging said carrier member adjacent said panel member with said display elements opposite said corresponding aperture, respectively;

(e) connecting said first and second bearing means, whereby said display elements are adapted for rotation about an axis parallel to the plane containing said display elements are adapted for rotation about an axis parallel to the plane containing said matrix panel member; and (f) removing said carrier member from said panel member.

2. A method as defined in claim 1, wherein said first bearing means are integrally formed with said matrix panel member.

3. A method as defined in claim 2, wherein said matrix panel member is injection molded from a synthetic plastic material.

4. A method as defined in claim 2, wherein said matrix panel member is pressed from a sheet of spring steel.

5. A method as defined in claim 1, wherein said first bearing means are formed on a frame, and further comprising the step of attaching said frame to said panel.

6. A method as defined in claim 4, and further comprising the step of removing a portion of said frame from said panel.

7. A method as defined in claim 1, wherein said display elements are integrally formed with said carrier member, and further comprising the step of separating said carrier member from said display elements after said first and second bearing means are connected.

8. A method as defined in claim 1, wherein said carrier member includes an array of receptacles, each of which is adapted to receive and retain one of said display elements, respectively.

9. A method as defined in claim 8, and further comprising the steps of punching said array of display elements from a sheet and inserting them in said carrier member receptacles.

10. An information display device, comprising (a) a matrix panel member containing an array of spaced apertures;

(b) a plurality of first bearing means connected with said panel member adjacent said apertures;

(c) a plurality of display elements each including second bearing means adapted for connection with said first bearing means; and (d) means for interconnecting said display elements to define a planar array corresponding with said array of spaced apertures, whereby when said array of display elements is arranged adjacent said array of apertures and said second bearing means are connected with said first bearing means, and subsequently when said display elements are disconnected from said interconnecting means, said display elements are adapted for rotation via said bearing means about an axis parallel to the plane containing said matrix panel member.

11. Apparatus as defined in claim 10, wherein said means for interconnecting said display elements comprises a generally planar carrier member including an array of receptacles each of which is adapted to receive and retain one of said display elements, respectively.

12. Apparatus as defined in claim 11, wherein said display elements are punched at a predetermined spacing from a planar sheet and deposited in said receptacles, respectively.

13. Apparatus as defined in claim 10, wherein said first bearing means are integrally formed on a frame connected with said panel member, said first bearing means being arranged in a plurality of rows and columns corresponding with said array of panel apertures.

14. Apparatus as defined in claim 13, wherein said first bearing means are formed from synthetic plastic material.

15. Apparatus as defined in claim 13, wherein said first bearing means are formed from a sheet of metal.

16. Apparatus as defined in claim 15, wherein said metal sheet is coated with synthetic plastic material.

17. Apparatus as defined in claim 10, wherein each display element includes a permanent magnet.

18. A method of manufacturing an information display device comprising a matrix of display elements each having a rotatable member, comprising the steps of (a) producing a common support member having first bearing means for rotatable members of display elements;

(b) providing a component out of which at least a row of rotatable members can be made by severing from said component, said component including integral means joining said rotatable members together, each rotatable member including second bearing means for connection with said first bearing means;

(c) placing said component on said support member; and (d) severing and removing said joining means and connecting said first and second bearing means to provide individual rotatable members mounted on said support member for rotation about an axis parallel to the plane containing said support members.

19. A method according to claim 18, wherein said component comprises a matrix of said rotatable members.

20. A method according to claim 18, wherein said component is sheet-like.

21. A method of manufacturing a matrix display device of the type comprising an array of rotatable members mounted on a common support sheet, comprising the steps of (a) producing a common support sheet having first bearing means for rotatable members;

(b) providing a component out of which an array of individual rotatable members can be made by severing from said component, each rotatable member including second bearing means for connection with said first bearing means, said component including integral means joining said rotatable members together;

(c) placing said component opposite a jig having an array of receptacles each aligned with and arranged to receive a corresponding rotatable member on said component;

(d) severing said rotatable members from said component and placing them directly into their corresponding receptacles;

(e) placing said jig opposite said support sheet;

(f) transferring said rotatable members from said jig to said support sheet; and (g) connecting said first and second bearing means leaving said rotatable members mounted for rotation about an axis parallel to a plane containing said support member.

22. An information display device including a matrix of display elements arranged in horizontal and vertical rows, each display element including a rotatable member comprising a vane and a bearing element arranged for rotation about an axis extending parallel to the plane of said matrix, said matrix including a sheet-like support member arranged to include an array of several protruding bearing members each being an integral part thereof, each protruding bearing member including a bearing surface against which one of said bearing elements bears, one of said protruding bearing member and said bearing element including a hollow surface providing an axial bearing open in a direction orthogonal to said axis, thereby to enable an array of said rotatable members to be simultanously fitted to said sheet-like support member during manufacturing assembly of said matrix.

23. An information display device as defined in claim 22, wherein said support member includes a matrix of said protruding bearing members.

24. An information display device as defined in claim 22, wherein said support member includes integrally formed means arranged to entrap the bearing elements of said rotatable members.

25. An information display device as defined in claim 22, wherein said support member is pressed from a sheet of material.

26. An information display device as defined in claim 22, including a panel connected with said support member, said panel bearing arranged to be light-passing in areas thereof adjacent said bearing members.

27. An information display device as defined in claim 22, and further comprising means for interconnecting said rotatable members to define a planar array corresponding with said array of protruding bearing members, whereby when said array of bearing elements is arranged adjacent said array of bearing members and said bearing members are connected with said bearing elements, and subsequently when said display elements are disconnected from said interconnecting means, said rotatable members are adapted for rotation.

28. An information display device as defined in claim 27, wherein said means for interconnecting said display elements comprises a generally planar carrier member including an array of receptacles each of which is adapted to receive and retain one of said rotatable members, respectively.

29. An information display device as defined in claim 28, wherein said rotatable members are punched at a predetermined spacing from a planar sheet and deposited in said receptacles, respectively.

* * * * *